US007572314B2

(12) United States Patent
Choi et al.

(10) Patent No.: US 7,572,314 B2
(45) Date of Patent: Aug. 11, 2009

(54) CARBON CONTAINING NICKEL PARTICLE AND CONDUCTIVE PASTE

(75) Inventors: Jae-young Choi, Gyeonggi-do (KR); Soon-ho Kim, Seoul (KR); Tae-Kyoung Kim, Gyeonggi-do (KR); Hak-joon Lee, Gyeonggi-do (KR); Seon-mi Yoon, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/822,639

(22) Filed: Jul. 9, 2007

(65) Prior Publication Data

US 2007/0269673 A1 Nov. 22, 2007

Related U.S. Application Data

(63) Continuation of application No. 10/996,387, filed on Nov. 26, 2004, now Pat. No. 7,258,721.

(30) Foreign Application Priority Data

Nov. 25, 2003 (KR) ..... 2003-84172
Nov. 10, 2004 (KR) ..... 2004-91458

(51) Int. Cl.
*B22F 1/02* (2006.01)
*H01B 1/22* (2006.01)

(52) U.S. Cl. ..... 75/252; 252/513; 428/570

(58) Field of Classification Search ..... 75/255, 75/252; 252/513; 428/570
See application file for complete search history.

(56) References Cited

U.S. PATENT DOCUMENTS

| | | | |
|---|---|---|---|
| 4,079,156 | A | 3/1978 | Youtsey et al. |
| 4,539,041 | A | 9/1985 | Figlarz et al. |
| 5,964,918 | A | 10/1999 | Asada et al. |
| 6,007,743 | A | 12/1999 | Asada et al. |
| 6,120,576 | A | 9/2000 | Toshima et al. |
| 6,235,077 | B1 | 5/2001 | Kagohashi et al. |
| 2005/0262966 | A1 | 12/2005 | Chandler et al. |

FOREIGN PATENT DOCUMENTS

| | | |
|---|---|---|
| EP | 641032 A1 | 3/1995 |
| JP | 63-020032 | 1/1988 |
| JP | 2000-094253 | 3/2000 |
| JP | 2001131602 | 5/2001 |
| JP | 2001160506 | 6/2001 |
| JP | 2001-284161 | 10/2001 |
| JP | 2002025847 | 1/2002 |

OTHER PUBLICATIONS

Chinese Office Action dated Feb. 9, 2007 and English translation thereof.

*Primary Examiner*—Roy King
*Assistant Examiner*—Ngoclan T Mai
(74) *Attorney, Agent, or Firm*—Cantor Colburn LLP

(57) ABSTRACT

Carbon-containing nickel-particle powder is provided. The carbon-containing nickel-particle powder has improved shrinkage property when fired due to the presence of carbon. Also, the carbon-containing nickel-particle powder has a very restricted degree of forming agglomerates.

18 Claims, 3 Drawing Sheets

CARBON CONTAINING NICKEL PARTICLE AND CONDUCTIVE PASTE

This is a Continuation Application of U.S. patent application Ser. No. 10/996,387, filed Nov. 26, 2004 now U.S. Pat. No. 7,258,721, issued on Aug. 21, 2007, which claims priority of Korean Patent Application No. 2003-84172, filed on Nov. 25, 2003, and Korean Patent Application No. 2004-91458 filed on Nov. 10, 2004 in the Korean Intellectual Property Office, the disclosures of which are incorporated herein in their entirety by reference.

BACKGROUND OF THE INVENTION

1. Field of the Invention

The present invention relates to nickel powder, and more particularly, to composite nickel powder.

2. Description of the Related Art

Nickel powder has various uses. One of the representative uses is the one as a material for manufacturing an inner electrode of an MLCC (multi-layer ceramic capacitor).

Generally, an MLCC is manufactured by laminating a number of thin dielectric layers and a number of inner electrodes. Although the MLCC has a relatively small volume, it has a large accumulating capacitance. Thus, the MLCC is widely used in electronic devices such as a computer, a mobile communication device, etc Ag—Pd alloy is used as an inner electrode material of MLCC. Ag—Pd alloy can be easily applied to the manufacturing of the MLCC because it is fired (sintered) in the air, but it is expensive. There was a tendency of replacing the inner electrode material with nickel, which is inexpensive, to lower the cost of the MLCC in the late 1990's. The nickel inner electrode of the MLCC is formed by coating a conductive paste, which comprises nickel metal powder, drying and co-firing.

It is required to minimize the size of an electronic component, particularly the MLCC, in order to continuously minimize the size of an electronic device. To minimize the size of the MLCC, ultra-thin ceramic dielectric layers and inner electrode layers are required.

Generally, an MLCC is manufactured by co-firing the ceramic dielectric layers and the inner electrode layers. A shrinkage rate of the inner electrode layer is higher than that of the ceramic dielectric layer because the inner electrode layer, before firing, has a low packing density with a high content of organic vehicles. Also, the temperature of shrinking of the nickel is about 400 to about 500° C., whereas that of $BaTiO_3$ generally used as the ceramic dielectric layer is more than about 1,100° C. These differences of the shrinkage rate and the temperature of shrinking between the inner electrode layer and the ceramic dielectric layer lead to a lowering of the connectedness of the inner electrode and delamination.

In order to lower the shrinkage rate and increase the temperature of shrinking of the nickel powder, it is proposed to reduce the oxygen content of the nickel powder and to use a composite nickel powder such as oxide-coated nickel powder. MgO, $SiO_2$, $TiO_2$, $BaTiO_3$, oxides of the rare-earth elements, etc. were used as nickel powder coating oxides. "Dry-type mechanochemical mixing" using a hybridizer (see the Japan patent laid-open publication No. 1999-343501), "Spray pyrolysis" (see U.S. Pat. No. 6,007,743), and "Wet-type sol-gel coating" (see the Japan patent laid-open publication No. 2002-25847) were used to coat the nickel powder with oxides.

In the case of the oxide-coated nickel powder manufactured by the mechanochemical mixing, bondage between the oxide particles and nickel particles is weak, and when it is processed into paste, there is a possibility that the oxide-coated nickel powder will be divided into the oxide particles and the nickel particles. Moreover, the improved effect of the heat shrinkage rate of the oxide-coated nickel powder manufactured by the mechanochemical mixing is known to be very low (see the Japan patent laid-open publication No. 1999-343501).

In the case of the above mentioned spray pyrolysis, the nickel powder comprising composite oxide was prepared by spraying the solution comprising a precursor of nickel and a thermally decomposable compound which can form a coating layer, and thermal decomposing. In the case of the nickel powder manufactured by the above mentioned spray pyrolysis, however, oxides were formed not only on the surface of the nickel particle, but also in the nickel particle. Due to this, the oxides can remain as impurities after forming the nickel electrode (see the U.S. Pat. No. 6,007,743).

In the case of the wet-type sol-gel coating, the physicochemical coating is carried out by adding the nickel powder into an aqueous solution of coating layer-forming material and reacting the solution with the nickel powder. And then, the coating layer of the coated nickel powder is crystallized by heat treatment of the coated nickel powder. Compared to the oxide-coated nickel powder manufactured by the mechanochemical mixing, the oxide-coated nickel powder manufactured by the above mentioned wet-type sol-gel coating has stronger bonding powder to the coating layer. Also, unlike the oxide-coated nickel powder manufactured by the spray pyrolysis, the oxide-coated nickel powder manufactured by the wet-type sol-gel coating has an oxide layer with the desired content only on its own surface.

However, since most wet-type sol-gel coating methods use water-based coating solution (see the Japan patent laid-open publication No. 2001-131602), hydroxyl groups remain in the coating layer of the produced nickel powder. During the process of drying, agglomeration of the oxide-coated nickel powder occurs by a condensation reaction of the remaining hydroxyl groups. The agglomerates formed during the drying process are maintained as formed during the heat treatment process for crystallization, and the strength of the agglomerates increases as the crystallization of the coating layer is increased.

Conductive paste is manufactured by dispersing an oxide-coated nickel powder in an organic solvent, and the conductive paste is printed on a dielectric sheet, thereby forming an inner electrode layer. The properties of the inner electrode layer printed on the dielectric sheet can be fatally affected by the agglomeration of the nickel powder in the conductive paste. That is, the agglomerated nickel powder protruded from the inner electrode layer and the roughness of the inner electrode layer was increased. When the inner electrode layer having increased roughness is fired, a breaking of the inner electrode layer occurred so that the quality of the MLCC is lowered.

SUMMARY OF THE INVENTION

The present invention provides composite nickel-particle powder that agglomerates less and has an improved shrinkage property during a firing process.

According to other aspect of the present invention, there is provided a method of manufacturing the composite nickel-particle powder.

According to another aspect of the present invention, there is provided a conductive paste comprising the composite nickel-particle powder.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
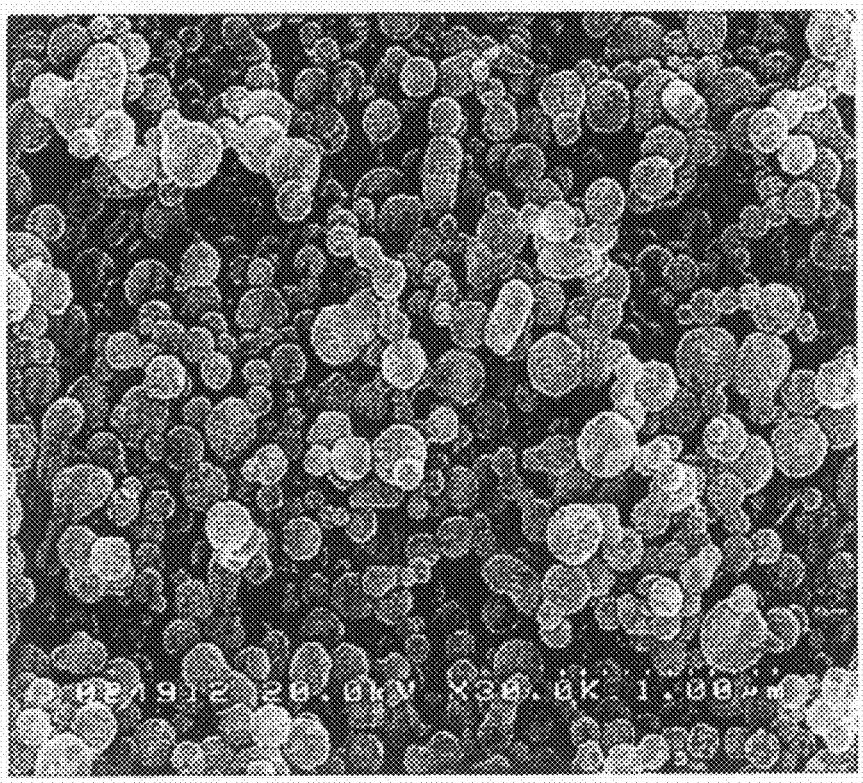
FIG. 1 is an SEM photograph of nickel metal particles used as a raw material.

The present invention will be described in more detail by describing embodiments thereof.

The composite nickel-particle powder according to the present invention is carbon-containing nickel-particle powder. The carbon-containing nickel-particle powder according to the present invention has an improved shrinkage property, when it is fired, due to the presence of carbon. Being prepared-by the method described hereinafter, the carbon-containing nickel-particle powder according to the present invention has also a very restricted degree of forming agglomerates.

The method of manufacturing carbon-containing nickel-particle powder according to the present invention comprises preparing raw material dispersion solution comprising nickel-particle powder and organic solvent, and heating the raw material dispersion solution to incorporate carbon into the nickel-particle powder.

The conductive paste according to the present invention comprises the carbon-containing nickel-particle powder, an organic binder and an organic solvent.

Hereinafter, the carbon-containing nickel-particle powder will be more fully described.

The carbon-containing nickel-particle powder according to the present invention comprises a carbon-containing nickel-particle. The carbon-containing nickel-particle comprises nickel metal particle and carbon incorporated in the nickel metal particle.

The carbon may be an atom or in a particle form. The carbon may be adsorbed on the surface of the nickel metal particle or penetrate into the nickel metal particle. Otherwise, the carbon-containing nickel-particle comprises a carbon adsorbed on the surface of the nickel metal particle and a carbon which penetrated into the nickel metal particle.

The carbon incorporated in the nickel metal particle may be evenly dispersed through the entire nickel metal particle, or mainly distributed in the surface layer of the nickel metal particle, or distributed only in the surface layer of the nickel metal particle. The term "surface layer of the nickel metal particle" is used herein to broadly refer to the surface of the nickel metal particle.

In an embodiment wherein the carbon is distributed only in the surface layer of the nickel metal particle, if the surface layer of the nickel metal particle is too thin, the effect of restraining the shrinkage during the firing process may be too weak, and if the surface layer of the nickel metal particle is too thick, there may remain too many impurities in the nickel metal after the firing process. On account of this, the thickness of the surface layer may be typically about 0.5 to about 100 nm. In accordance with requirements of a specific field of application, the carbon-containing nickel-particle powder, which has a surface layer having a thickness outlined by the above bounds, may be used usefully depending on the size of the nickel metal particle.

The carbon content of the carbon-containing nickel-particle powder may be varied in accordance with the thickness of the surface layer, the absorbing degree of the carbon, and the incorporating degree of the carbon. If the carbon content of the carbon-containing nickel-particle powder is too low, the effect of restraining the shrinkage during the firing process may be too weak, and if the carbon content of the carbon-containing nickel-particle powder is too high, there may remain too many impurities in the nickel metal after the firing process. On account of this, the carbon content of the carbon-containing nickel-particle powder may be typically about 0.1 to about 7% by weight.

The average particle size of the carbon-containing nickel-particle powder may not be restricted to a specific size range, and it may be selected properly in accordance with the necessity of a specific field of application. The average particle size of the carbon-containing nickel-particle powder may be typically about 30 to about 8,000 nm. When the carbon-containing nickel-particle powder is used as an inner electrode material of the MLCC, the average particle size of the carbon-containing nickel-particle powder may be preferably about 30 to about 800 nm, more preferably about 30 to about 300 nm.

The nickel metal particle may have various crystalline structure such as FCC (face-centered cubic) or HCP (hexagonal closed packed), etc. The nickel metal particle may be also amorphous phase. The nickel metal particle may have various shapes such as a spherical shape, a disk shape, a needle shape, a plate shape and so on, but the shape is not limited to these.

A representative use of the carbon-containing nickel-particle powder according to the present invention is one as a material for manufacturing an inner electrode of an MLCC. In this case, during co-firing process of manufacturing an MLCC, the carbon-containing nickel-particle powder according to an embodiment of the present invention shows a shrinkage temperature of at least about 800° C. This result shows an improved shrinkage temperature when compared to the case of using a carbon-free nickel metal particle that shows a shrinkage temperature of about 400 to about 500° C. Also, in the case of using the carbon-containing nickel-particle powder according to the present invention, breaking of the inner electrode layer is very suppressed. This means that the carbon-containing nickel-particle powder according to the present invention shows a lowered shrinkage rate. The shrinkage rate of the carbon-containing nickel-particle powder is a shrinkage rate relative to that of the dielectric layer of the MLCC. The carbon-containing nickel-particle powder according to embodiments of the present invention shows a significantly low shrinkage rate because the difference between the shrinkage temperature of the carbon-containing nickel-particle powder and that of the dielectric layer material is reduced.

During the firing process, the carbon incorporated in the carbon-containing nickel-particle powder according to the present invention is oxidized into CO or $CO_2$ under a high temperature, such as at least about 900° C., and removed.

Therefore, the resulting nickel electrode may have a high conductivity intrinsic to nickel metal.

The carbon-containing nickel-particle powder can be used in various purposes such as electrode forming paste for MLCC, paste for LTCC, paint additives, catalyst for CNT growing, hydrogen storage material, catalyst for promoting chemical reaction, etc.

Hereinafter, the method of manufacturing the carbon-containing nickel-particle powder according to the present invention is more fully described.

The manufacturing method according to the present invention comprises preparing a raw material dispersion solution including nickel metal particle powder and polyol, and heating the raw material dispersion solution to incorporate carbon into the nickel metal particle.

As the nickel metal particle, commercially available products such as NF1A, NF3A (manufactured by Toho Company Ltd., Japan), YH642, YH643, NST-920, NST-940 (manufactured by Sumitomo Company Ltd., Japan), NFP201S (manufactured by Kawatestu Company Ltd., Japan), 609S (manufactured by Shoei Company Ltd., Japan), and products manufactured by various methods such as "Process for production of nickel powder (vaporization method)" (see U.S. Pat. No. 6,235,077), "Process for preparing metal powder (spray pyrolysis)" (see U.S. Pat. No. 5,964,918), and "Process for preparing nickel fine powder (liquid-phase reduction method)" (see U.S. Pat. No. 6,120,576) can be used, but are not limited to these.

The nickel metal particle powder may have crystalline phase such as FCC or HCP, or amorphous phase. The average particle size of the nickel metal particle may be typically about 10 to 8,000 nm, but is not limited to the range.

The polyol acts as a dispersion medium to the nickel metal particle powder and as a medium for providing a reduction atmosphere to the nickel metal particle powder. The polyol is an alcoholic compound having two, three or more hydroxyl groups.

Examples of the polyol include aliphatic glycols, which are dihydric alcohol, and glycol polyesters thereof, etc.

Examples of the aliphatic glycols include alkylene glycols such as ethanediol, propanediol, butanediol, pentanediol and hexanediol; and derivatives thereof such as polyalkylene glycols such as polyethylene glycols. The alkylene glycols may have a backbone in which carbon number is 2 to 6.

Other examples of the aliphatic glycols include diethylene glycol, triethylene glycol and dipropylene glycol, etc.

Also, other examples of the polyols include glycerols, which are trihydric alcohols, etc.

The polyols are not limited to the above cited polyol compounds. And the polyol compounds can be used as a sole compound or mixtures thereof.

More preferably, ethylene glycol, diethylene glycol, triethylene glycol, tetraethylene glycol, 1,2-propanediol, 1,3-propanediol, dipropylene glycol, 1,2-butanediol, 1,3-butanediol, 1,4-butanediol or 2,3-butanediol can be used as the polyol.

The content of the polyol in the raw material dispersion solution is not particularly limited. If the content of the polyol in the raw material dispersion solution is too low, the degree of forming agglomerates in the produced powder may be increased, and if it is too high, it may cause economical inefficiency since the polyol is used excessively. On account of this, the content of the polyol in the raw material dispersion solution is typically in the range of about 200 to about 1,000,000 parts by weight based on 100 parts by weight of the nickel metal particle powder.

In order to form carbon coating on the nickel metal particle in the raw material dispersion solution, the raw material dispersion solution is heated. In this process, the polyol is decomposed to carbon and the carbon is adsorbed or incorporated into the nickel metal particle.

The term "heating" means raising the temperature of the raw material dispersion solution above the room temperature, and particularly to more than about 20° C. The heating temperature may be a fixed value or gradually varied in a specific range of temperatures higher than the room temperature. Within the scope of the present invention, various heating methods can be used.

More preferably, in order to promote forming the carbon coating, the heating temperature may be at least about 150° C.

Conventionally, the higher the heating temperature is, the higher the forming speed of the carbon coating is. However, at a temperature higher than a certain degree, the speed of forming the carbon coating cannot be increased, and the reacting materials may be deteriorated. On account of this, the heating is preferably regulated at the temperature not higher than about 350° C.

The manufacturing method according to the present invention may be carried out in an open reaction vessel or a closed reaction vessel. It is more preferable to use a closed reaction vessel in order to increase the temperature of the heating process up to a temperature higher than a boiling point of the polyol used. The reaction vessel, whether it is open or closed, may be equipped with a condenser or refluxing condenser.

In one embodiment of the manufacturing method according to the present invention, which uses a refluxing condenser-equipped, open reaction vessel, it is preferable to heat the raw material dispersion solution to a temperature near a boiling point of the polyol used during heating of the raw material dispersion solution in the heating process to form carbon coating layer. In this case, if the temperature of the raw material dispersion solution is far below the boiling point of the polyol used, the carbon coating may not be sufficiently formed. Whereas, if the temperature of the raw material dispersion solution is far above the boiling point of the polyol used, a high-pressure type reaction vessel is required. On account of this, the temperature of the raw material dispersion solution may be in the range of ±5° C. based on the boiling point of the polyol used. More preferably, the raw material dispersion solution may be heated so that the polyol in the solution may be in the boiling state.

In order to form a carbon-coating layer, the time for heating the raw material dispersion solution is not particularly limited in the present invention. The heating time can be set enough to coat substantially all of the nickel metal particles with carbons. The heating time can be easily determined in accordance with the reaction condition.

Hereinafter, conductive paste according to the present invention will be more fully described.

The conductive paste according to the present invention comprises a carbon-coated nickel-particle powder, an organic binder and an organic solvent. The carbon-coated nickel-particle powder described above can be used as the carbon-coated nickel-particle powder. For example, ethylcellulose, etc. can be used as the organic binder. For example, terpineol, dihydroxy terpineol, 1-octanol kerosene, etc. can be used as the organic solvent.

The conductive paste according to the present invention comprises 40% by weight of the carbon-coated nickel-particle powder, 15% by weight of an organic binder and 45% by weight of an organic solvent. However, the composition is only an example, and may vary in accordance with the necessity of a specific field of application.

Also, the conductive paste according to the present invention further comprises additives such as a plasticizer, an antithickening agent, a dispersant, etc. As the manufacturing method of the conductive paste according to the present invention, various conventionally known methods can be used, and will not further described in the present specification.

The conductive paste according to the present invention can be used in various applications such as manufacturing an MLCC which comprises a nickel inner electrode, manufacturing an electrode for LTCC, paint additives, catalyst for CNT growing, hydrogen storage material, catalyst for promoting chemical reaction, etc.

Thus, the present invention will be described in more detail with reference to the following examples. The following examples are for illustrative purposes and are not intended to limit the scope of the invention.

EXAMPLE 1

100 g of NF1A nickel metal powder manufactured by Toho Company Ltd. (Japan) was added to and dispersed in 1 liter of diethylene glycol to produce a raw material dispersion solution. After the dispersion solution was added into a reaction vessel equipped with a refluxing condenser, the solution was heated until the diethylene glycol in the solution boiled. The temperature of the dispersion solution was about 220° C. The heating time of the dispersion solution was about 6 hours.

Figure 2:
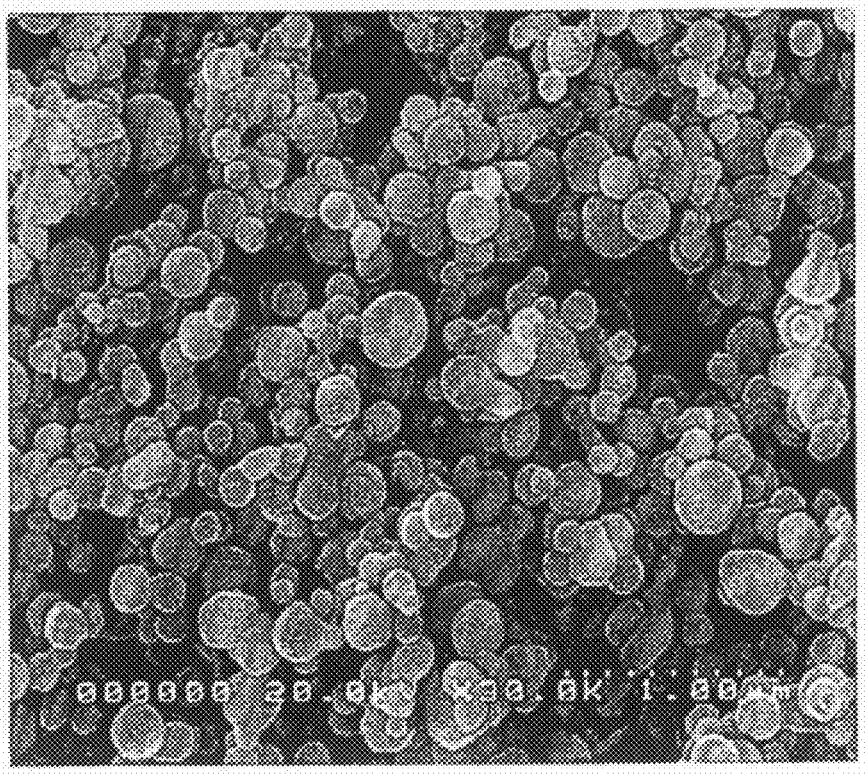
FIG. 2 is an SEM photograph of carbon-containing nickel powder prepared using the nickel metal particles as a raw material.

The yielded carbon-containing nickel-particle powder contained about 5.5% by weight carbon. During the manufacturing of the carbon-containing nickel-particle powder, the nickel particles didn't agglomerate, and the dispersion degree of the nickel metal particles, used as a raw material, at the beginning was maintained, as shown in FIGS. 1 and 2. FIG. 1 is an SEM (scanning electron microscope) photograph of a nickel metal powder used as a raw material, and FIG. 2 is an SEM photograph of a carbon-containing nickel-particle powder produced from the nickel metal powder of FIG. 1.

Figure 4:
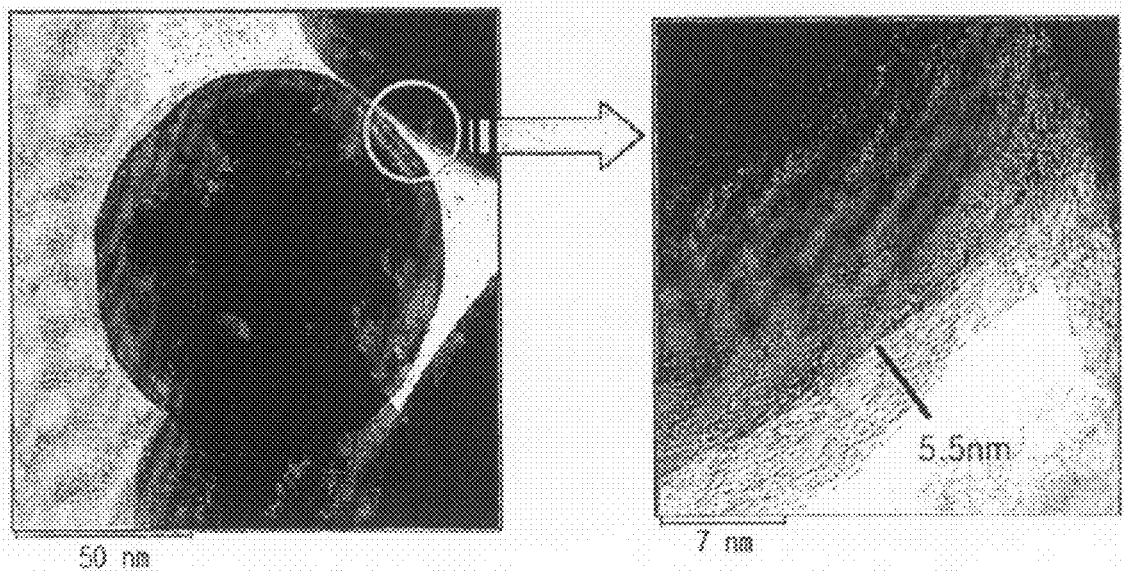
FIG. 4 is a TEM photograph of the carbon-containing nickel-particle prepared in Example 1 according to the present invention.

FIG. 4 is a TEM photograph of a carbon-containing nickel particle prepared in this example. Referring to FIG. 4, the carbon-containing nickel particle has a surface layer having a 5.5 nm thickness. The main component of the surface layer seems to be carbon.

EXAMPLE 2

100 g of NF1A nickel metal powder manufactured by Toho Company Ltd. (Japan) was added to and dispersed in 1 liter of diethylene glycol to produce a raw material dispersion solution. After the dispersion solution was added into a reaction vessel equipped with a refluxing condenser, the solution was heated until the diethylene glycol in the solution boiled. The temperature of the dispersion solution was about 220° C. The heating time of the dispersion solution was about 2 hours.

The yielded carbon-containing nickel-particle powder contained about 0.96% by weight carbon. During the manufacturing of the carbon-containing nickel-particle powder, nickel particles didn't agglomerate, and the dispersion degree of the nickel metal particles, used as a raw material, at the beginning was maintained.

EXAMPLE 3

50 g of NF1A nickel metal powder manufactured by Toho Company Ltd. (Japan) was added to and dispersed in 1 liter of diethylene glycol to produce a raw material dispersion solution. After the dispersion solution was added into a reaction vessel equipped with a refluxing condenser, the solution was heated until the diethylene glycol in the solution boiled. The temperature of the dispersion solution was about 220° C. The heating time of the dispersion solution was about 2 hours.

The yielded carbon-containing nickel-particle powder contained about 1.16% by weight carbon. During the manufacturing of the carbon-containing nickel-particle powder, nickel particles didn't agglomerate, and the dispersion degree of the nickel metal particles, used as a raw material, at the beginning was maintained.

COMPARATIVE EXAMPLE 1

NF1A nickel metal powder manufactured by Toho Company Ltd. (Japan) was used as a raw material.

COMPARATIVE EXAMPLE 2

NI609S nickel metal powder manufactured by Toho Company Ltd. (Japan) was used as a raw material.

COMPARATIVE EXAMPLE 3

100 g of NF1A nickel metal powder manufactured by Toho Company Ltd. (Japan) was added to and dispersed in 1 liter of ethylene glycol to produce a raw material dispersion solution. After the dispersion solution was added into a reaction vessel equipped with a refluxing condenser, the solution was heated until the ethylene glycol in the solution boiled. The temperature of the dispersion solution was about 220° C. The heating time of the dispersion solution was about 2 hours.

EXPERIMENTAL EXAMPLE

Shrinkage Rate Measurement

Figure 3:
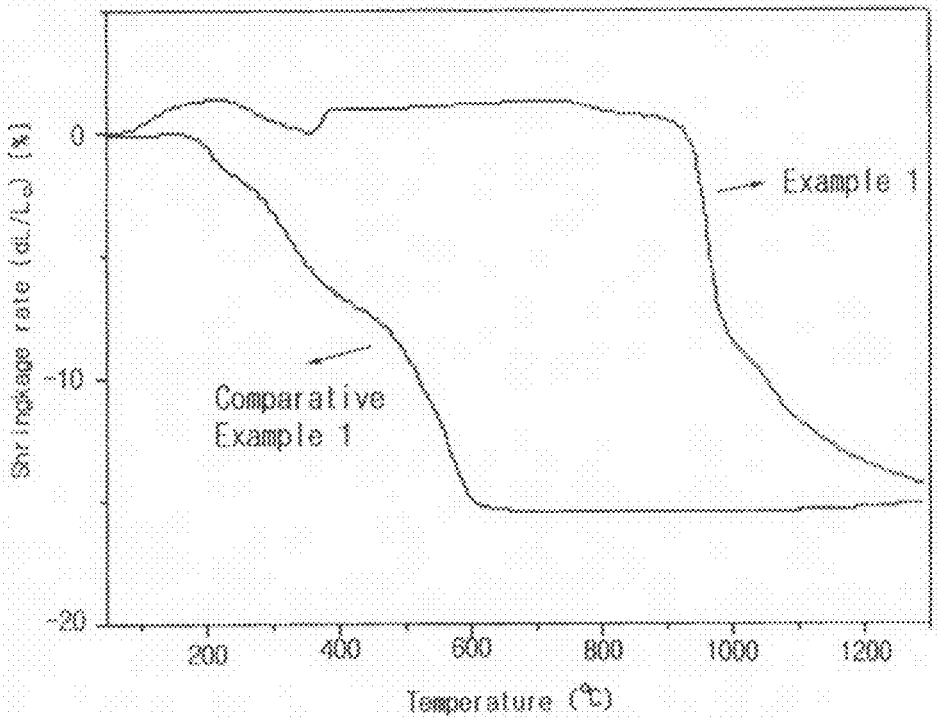
FIG. 3 is a graph of shrinkage rate with respect to temperature when the carbon-containing nickel powder (Example 1) according to the present invention and the carbon-free nickel metal particle (Comparative Example 1) are fired.

Each of the nickel metal powders used as a raw material in Comparative Example 1 and the carbon-containing nickel powder prepared in Example 1 were molded using a mold to obtained products having a 5 mm diameter and a 4 mm height. The shrinkage rate of each of the molded products with respect to temperature was measured using a dilatometer. FIG. 3 is a graph showing shrinkage characteristics of the molded products manufactured from the two different kinds of nickel powder. As shown in FIG. 3, the shrinkage starting temperature of the carbon-free nickel metal powder prepared in Comparative Example 1 was as low as about 200° C. while the shrinkage starting temperature of the carbon-containing nickel powder prepared in Example 1 according to the present invention was as high as about 900° C.

Figure 5:
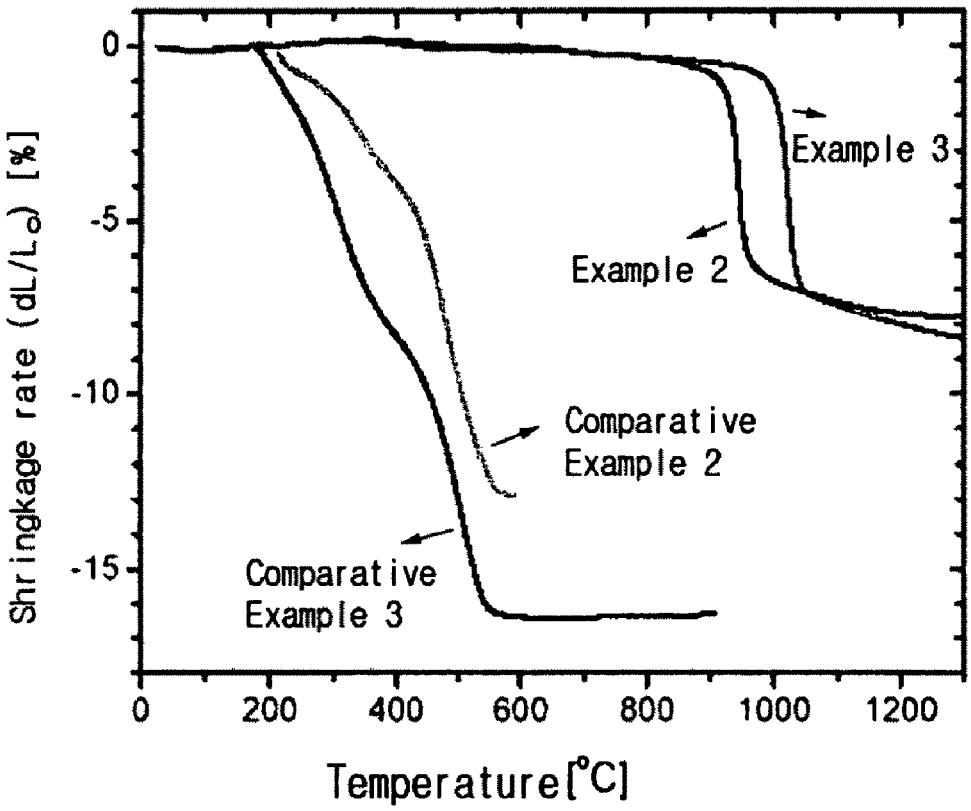
FIG. 5 is a graph of shrinkage rate with respect to temperature, for the nickel powder prepared in Examples 2 and 3 according to the present invention and Comparative Examples 2 and 3.

Molded products were manufactured from the powder prepared in Examples 2 and 3 and Comparative Examples 2 and 3 using the same method as described above, and the shrinkage rate with respect to temperature was measured using the molded products. The results are shown in FIG. 3. Referring to FIG. 5, the shrinkage starting temperature of the molded product manufactured using the carbon-containing nickel powder of Example 2 according to the present invention was 931° C., and the shrinkage starting temperature of the molded product manufactured using the carbon-containing nickel powder of Example 3 according to the present invention was 1,007° C., However, the shrinkage starting temperature of the molded product manufactured using the nickel powder prepared in Comparative Example 2, was as low as 205° C., and the shrinkage starting temperature of the molded product manufactured using the nickel powder in Comparative Example 3, which contained only 0.02% by weight carbon was as further low as 186° C.

The carbon-containing nickel-particle powder according to the present invention has a very restricted degree of forming agglomerates and an improved shrinkage property when fired. Thus, it is useful as an inner electrode forming material for MLCC. That is, by using the carbon-containing nickel-particle powder according to the present invention, uniformity of the printed electrode layer may be improved, thus the breaking of the inner electrode layer may be suppressed. Also, since the electrode layer can be shrunken uniformly during the firing process, the stress in the resultant electrode can be drastically lowered.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A carbon-containing nickel particle having a shrinkage temperature of at least 600° C. comprising a nickel metal particle and carbon distributed on the surface thereof as a surface layer in a thickness of about 0.5 to 100 nm, wherein the average particle size of said carbon-containing nickel particle is about 30 to 800 nm.

2. The carbon-containing nickel particle of claim 1, wherein the carbon is adsorbed on the surface of said nickel metal particle.

3. The carbon-containing nickel particle of claim 1, wherein the carbon penetrates into said nickel metal particle.

4. The carbon-containing nickel particle of claim 1, wherein the average particle size of said carbon-containing nickel particle is about 30 to 300 nm.

5. A conductive paste comprising a carbon-containing nickel-particle powder having a shrinkage temperature of at least 800° C., wherein carbon is distributed on the surface of the nickel-particles of said carbon-containing nickel-particle powder as a surface layer in a thickness of about 0.5 to 100 nm and the carbon content of the carbon-containing nickel-particles is about 0.1 to 7% by weight; an organic binder; and an organic solvent.

6. The conductive paste of claim 5, wherein the carbon is adsorbed on the surfaces of the nickel metal particles of said carbon-containing nickel-particle powder.

7. The conductive paste of claim 5, wherein the carbon penetrates into said nickel metal particles of said carbon-containing nickel-particle powder.

8. A carbon-containing nickel particle of claim 1 having a shrinkage temperature of at least 800° C.

9. A carbon-containing nickel particle of claim 1, wherein the carbon content of said carbon-containing nickel particle is about 0.1 to 7% by weight.

10. A carbon-containing nickel particle of claim 1, wherein the carbon is distributed only in the surface layer of the nickel metal particle.

11. A carbon-containing nickel particle having a shrinkage temperature of at least 600° C. comprising a nickel metal particle and carbon distributed on the surface thereof as a surface layer in a thickness of about 0.5 to 100 nm, wherein the carbon is evenly dispersed through the entire nickel metal particle.

12. A carbon-containing nickel particle of claim 1, wherein the carbon is mainly distributed in the surface layer of the nickel metal particle.

13. A carbon-containing nickel particle of claim 2, wherein the carbon penetrates into said nickel metal particle.

14. A carbon-containing nickel particle of claim 5, wherein the carbon is distributed only in the surface layer of the nickel metal particle.

15. A carbon-containing nickel particle of claim 5, wherein the carbon is evenly dispersed through the entire nickel metal particle.

16. A carbon-containing nickel particle of claim 5, wherein the carbon is mainly distributed in the surface layer of the nickel metal particle.

17. A carbon-containing nickel particle of claim 5, wherein the conductive paste comprises:

40 wt % carbon-coated nickel-particle powder;

15 wt % organic binder; and 45 wt % organic solvent.

18. The conductive paste of claim 6, wherein the carbon penetrates into said nickel metal particles of said carbon-containing nickel-particle powder.

* * * * *